US009555656B2

(12) United States Patent
Sasaki

(10) Patent No.: US 9,555,656 B2
(45) Date of Patent: Jan. 31, 2017

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hidehito Sasaki, Tokyo (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/919,857

(22) Filed: Oct. 22, 2015

(65) Prior Publication Data

US 2016/0167417 A1 Jun. 16, 2016

(30) Foreign Application Priority Data

Dec. 15, 2014 (JP) ..... 2014-253296

(51) Int. Cl.
*B41M 7/00* (2006.01)
*G03G 15/20* (2006.01)
*G03G 15/00* (2006.01)

(52) U.S. Cl.
CPC ..... *B41M 7/0009* (2013.01); *G03G 15/2032* (2013.01); *G03G 15/5041* (2013.01); *G03G 15/6585* (2013.01)

(58) Field of Classification Search
CPC ..... B41M 7/0009; B41M 7/00; B41M 7/009
See application file for complete search history.

(56) References Cited

U.S. PATENT DOCUMENTS

| | | | | |
|---|---|---|---|---|
| 8,743,164 | B2 | 6/2014 | Iguchi et al. | |
| 8,963,973 | B2 * | 2/2015 | Imamiya | B41M 7/0009 347/179 |
| 9,104,154 | B2 | 8/2015 | Fujiwara | |
| 2009/0154970 | A1 | 6/2009 | Yoshida et al. | |
| 2013/0272729 | A1 | 10/2013 | Kato | |

* cited by examiner

*Primary Examiner* — Kristal Feggins
(74) *Attorney, Agent, or Firm* — Amin, Turocy & Watson LLP; Gregory Turocy

(57) ABSTRACT

An image forming apparatus includes a fixing device configured to include a pressure section and a heating section for heating an image receiving medium and to execute a fixing processing for fixing an image formed on the image receiving medium with a decolorable color material at a fixing temperature or an erasure processing for erasing an image at a decoloring temperature, a reading section configured to be arranged at the upstream side of the fixing device in the conveyance direction of the image receiving medium to read an identifier indicating whether or not the color material of the image formed on the image receiving medium can be decolorized, and a control section configured to control the execution of the erasure processing of the image on the image receiving medium with the fixing device according to a result of reading of the identifier with the reading section.

4 Claims, 6 Drawing Sheets

(a)

(b)

IMAGE FORMING APPARATUS

CROSS-REFERENCE TO RELATED APPLICATION

This application is based upon and claims the benefit of priority from Japanese Patent Application No. 2014-253296, filed Dec. 15, 2014, the entire contents of which are incorporated herein by reference.

FIELD

Embodiments described herein relate generally to an image forming apparatus.

BACKGROUND

As a form, it is known that an image forming apparatus comprises a decoloring apparatus which uses a recording material, for example, a decolorable toner to print an image on a sheet, and then executes a decoloring processing on the toner forming the image by heating to erase the image printed on the sheet. It is known that the decoloring apparatus, which includes a reading section configured to read an image to keep the image previous to being decolorized and a decoloring section configured to decolorize the toner forming the image, carries out an image reading processing with the reading section once again to determine whether or not the decoloring processing is normally executed after the decoloring processing. Thus, at the time the image formed on the sheet is decolorized, a series of operations, that is, reading and storing content of the sheet through the reading section and then decolorizing the content, are executed.

In recent years, a writing material the ink of which is colorless according to the change of temperature caused by heat is widespread. Such a writing material is used in a wide range from the use of check or memo to the use of drawing. In this way, due to the wide use, the area to be decolorized when the recorded content is useless is also increased, and the labor and the time are required in the decoloring job by the dedicated eraser. The cases of decolorizing an image with a duplicating machine that is arranged in the convenience store and capable of decolorizing an image through the heat are increased in order to decolorize the content recorded with the writing material. The decolorable ink of the writing material becomes colorless at about 65 degrees centigrade. In the duplicating machine, if the useless sheet is put into the sheet feeding stage to be subjected to a blank paper copy processing, the discharged sheet is decolorized because of being heated at a fixing temperature which is about 180 degrees centigrade for the general toner and is higher than the decoloring temperature. Thus, there is a problem that the memo and figures or the recorded characters in the critical document that are required to be left are also decolorized according to the relationship between the colorless temperature of the ink and the fixing temperature of the toner.

DETAILED DESCRIPTION

According to an embodiment of the present embodiment, a following module is taken. An image forming apparatus includes a fixing device configured to consist of a pressure section and a heating section for heating an image receiving medium and to execute a fixing processing for fixing an image formed with decolorable color material on the image receiving medium at a fixing temperature or an erasure processing for erasing an image at a decoloring temperature, a reading section configured to be arranged at the upstream side of the fixing device in the conveyance direction of the image receiving medium and to read an identifier indicating whether or not the color material of the image formed on the image receiving medium can be decolorized, and a control section configured to control the execution of the erasure processing of the image on the image receiving medium through the fixing device according to the result of the reading of the identifier by the reading section.

Hereinafter, an embodiment of the present invention is described with reference to the accompany drawings. An MFP (Multi-function peripheral) is exemplified as an image forming apparatus in the present embodiment.

Figure 1:
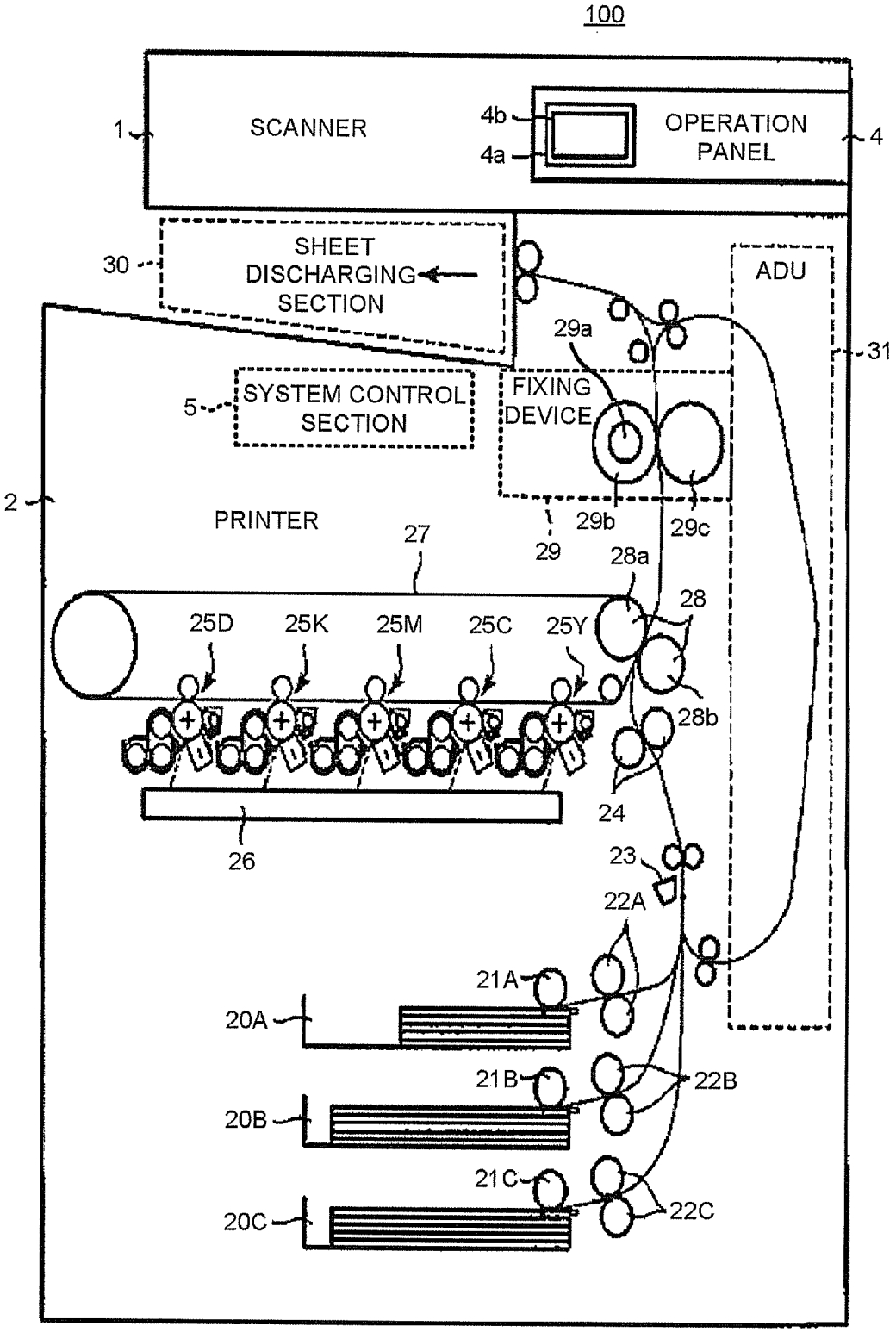
FIG. 1 is a cross-sectional diagram schematically illustrating an image forming apparatus according to an embodiment.

The present embodiment is described with reference to FIG. 1 to FIG. 6. FIG. 1 is a cross-sectional diagram schematically illustrating an example of the configuration of an MFP 100 according to the embodiment. The MFP 100 shown in FIG. 1 includes a scanner section 1, a printer section 2, an operation panel 4 and a system control section 5.

Figure 3:
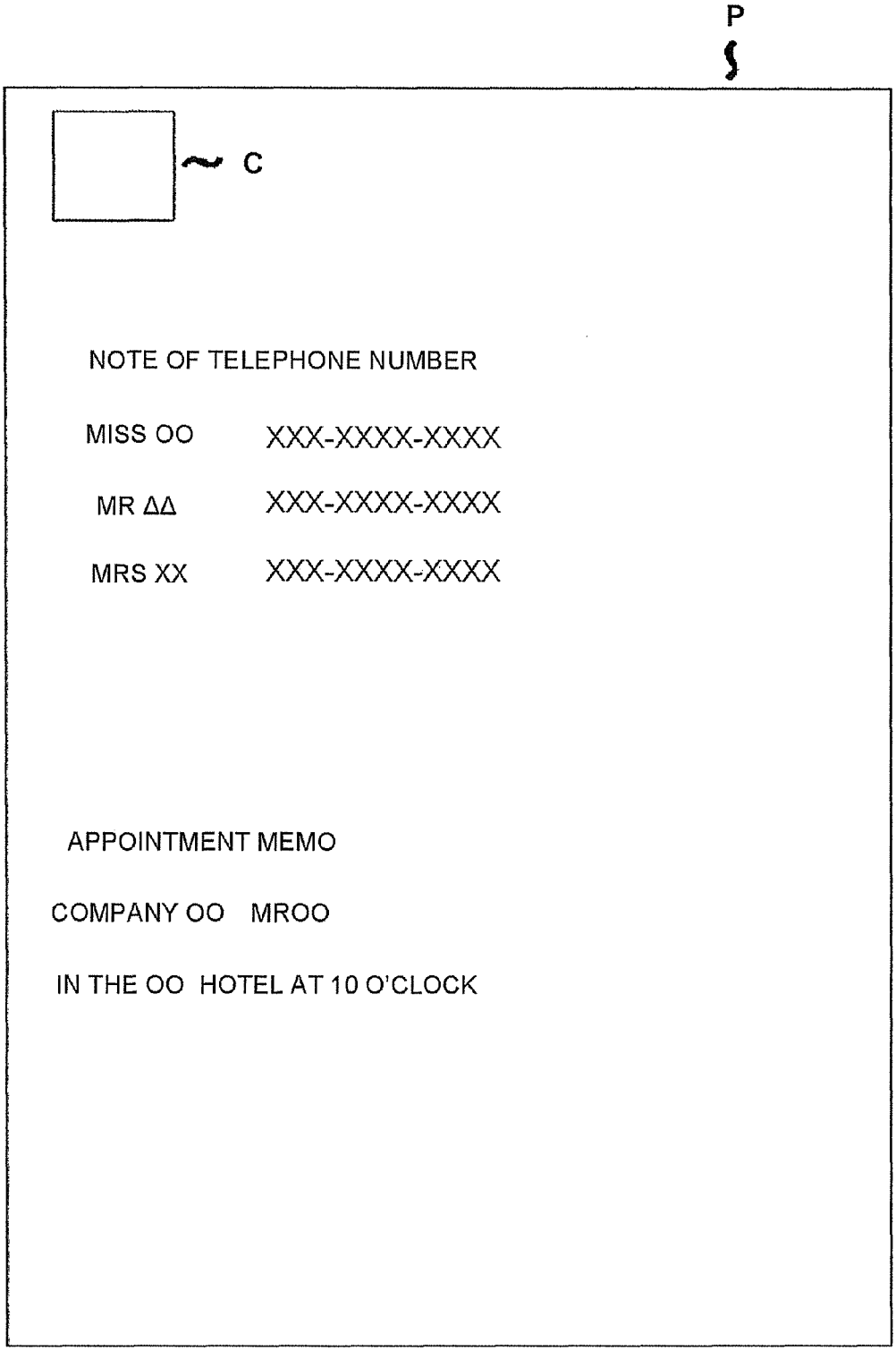
FIG. 3 is an illustration diagram illustrating a sheet P according to the embodiment.

In the embodiment, a check box C is formed at the end of a sheet P shown in FIG. 3 with a toner serving as a decolorable color material through the heat. Such a check box C is daubed with the writing material the ink of which is decolorized according to the change of the temperature caused by the heat. The daubed check box C is an identifier M. In a case in which the image formed on the sheet P is not desired to be erased, the identifier M is formed on the sheet P. In other words, the identifier M indicates whether or not the erasure processing can be executed on the image of the sheet P on which the image is formed. Moreover, it is assumed that the position of the check box C is printed previously at, besides the printable area of the MFP, an end of the printable area by the image forming apparatus such as a header or a footer defined in the document software and the like. In the embodiment, the decoloring operation is an example of the erasure processing.

In the FIG. 1, the scanner section 1 reads an image of an original document to convert the image into image data. The scanner section 1 having a well-known constitution is constituted by, for example, a CCD line sensor and the like which converts the image of the original document on the reading surface into image data. The scanner section 1 may scan the original document loaded on a document table glass (not shown) or read an image of the original document conveyed by an ADF (Auto Document Feeder). The scanner section 1 is arranged at the upper side of a main body of the MFP 100 and controlled by the system control section 5.

The printer section 2 forms an image on the sheet P serving as the image receiving medium. The printer section 2 in the embodiment is an electrophotographic type image forming section. The printer section 2 uses five kinds of toners (e.g. yellow (Y), cyan (C), magenta (M), black (B) and decoloration (D)) among the plurality of categories of toners to form the image. The yellow (Y), cyan (C), magenta (M) and black (B) toners are non-decolorable toners that cannot be decolorized even heated at a temperature above a prescribed fixing temperature. The decolorable toner (D) is a toner capable of being decolorized through being heated at a temperature above a prescribed temperature exceeding the fixing temperature and the color of the decolorable toner is, for example, deep blue or black. The details of the well-known configuration of generating an image by the printer section 2 are described later.

The decolorable toner used in the embodiment makes, for example, a binder resin contain a color material. The decolorable color material contains a coloring compound, developer and eraser. For example, a leuco dye is exemplified as the coloring compound; a phenol type is exemplified as the developer; and an agent that is miscible with the coloring compound if heated and has no affinity for the developer is exemplified as the eraser. The decolorable color material colors through the interaction between the coloring compound and the developer and is decolorized as the interaction between the coloring compound and the developer is suppressed because of being heated at a temperature above the decoloring temperature.

In the example of configuration shown in FIG. 1, the printer section 2 includes sheet feeding cassettes 20 (20A, 20B and 20C) as a sheet feeding section. For example, each of the sheet feeding cassettes 20A, 20B and 20C is arranged at the lower portion of the main body of the MFP 100 in an insertable and detachable state. Each of the sheet feeding cassettes 20A, 20B and 20C houses sheets P with set categories (e.g. size or paper quality), respectively. For example, if sheets P with different sizes are housed in these paper feeding cassettes 20A, 20B and 20C, it is possible to set these paper feeding cassettes respectively corresponding to each size. A sheet feeding section sensor is arranged in each of the paper feeding cassettes 20A, 20B and 20C and detects the storage quantity of sheets housed in the sheet feeding section 20. The sheet feeding section sensor is, for example, an infrared sensor, or may be a mechanical sensor using a well-known micro-switch. The sheet feeding section sensor sends the detection result to the system control section 5 described later. Further, the printer section 2 may include a manual tray (not shown) as another sheet feeding section.

The set information relating to the sheet P stored in each of sheet feeding cassettes 20A, 20B and 20C is stored in a non-volatile memory. The printer section 2 selects a sheet feeding cassette storing the sheet P used in the printing processing according to the set information. The printer section 2 prints an image on the sheet P fed from the selected sheet feeding cassette. If the printer section 2 includes the manual tray, the size of the sheet P set in the manual tray input from the operation panel 4 may be stored in the non-volatile memory.

In the following description, as the sheet is conveyed from the sheet feeding section 20 to a sheet discharging section 30, it is assumed that the side of the sheet feeding section 20 is an upstream side with respect to a sheet conveyance direction, and the side of the sheet discharging section 30 is a downstream side with respect to the sheet conveyance direction.

A conveyance section 22 shown in FIG. 1 conveys a sheet P within the printer section 2. The conveyance section 22 conveys a sheet P supplied from the corresponding sheet feeding cassette 20A, 20B or 20C to a register roller 24 through a pickup roller 21A, 21B or 21C. The register roller 24 conveys the sheet P to a transfer position at the timing when an image is transferred from an intermediate transfer belt 27 described later to the sheet P.

Figure 5:
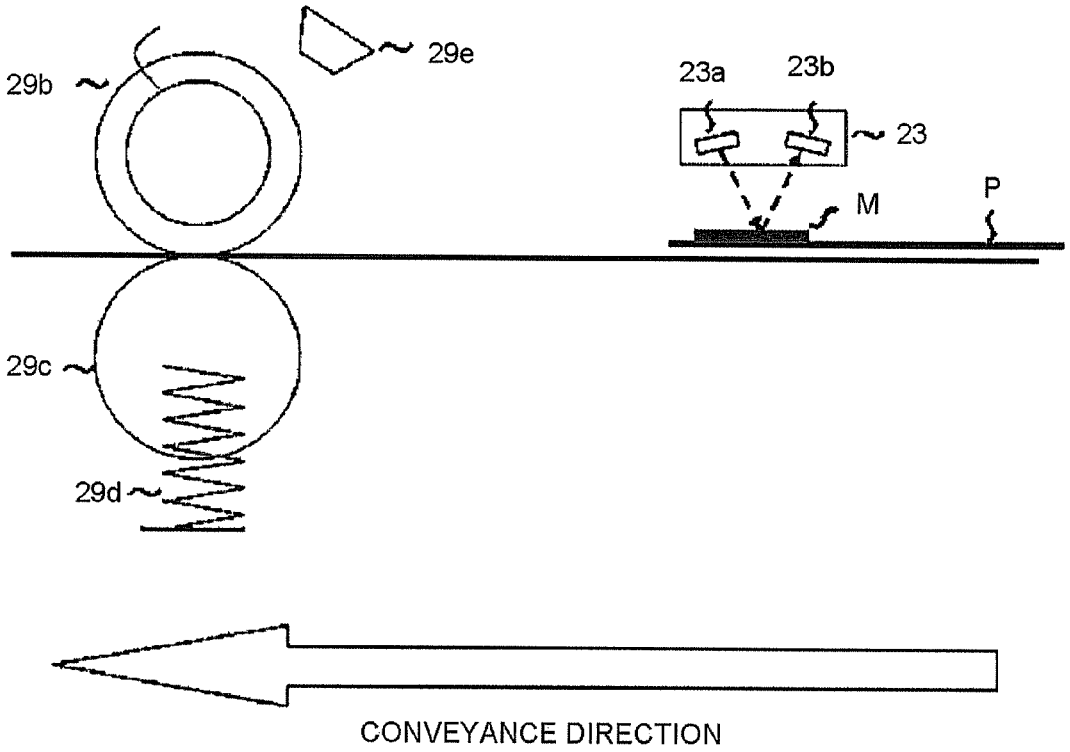
FIG. 5 is an illustration diagram schematically illustrating relationship between a fixing device and a reading section according to the embodiment.
Figure 5:
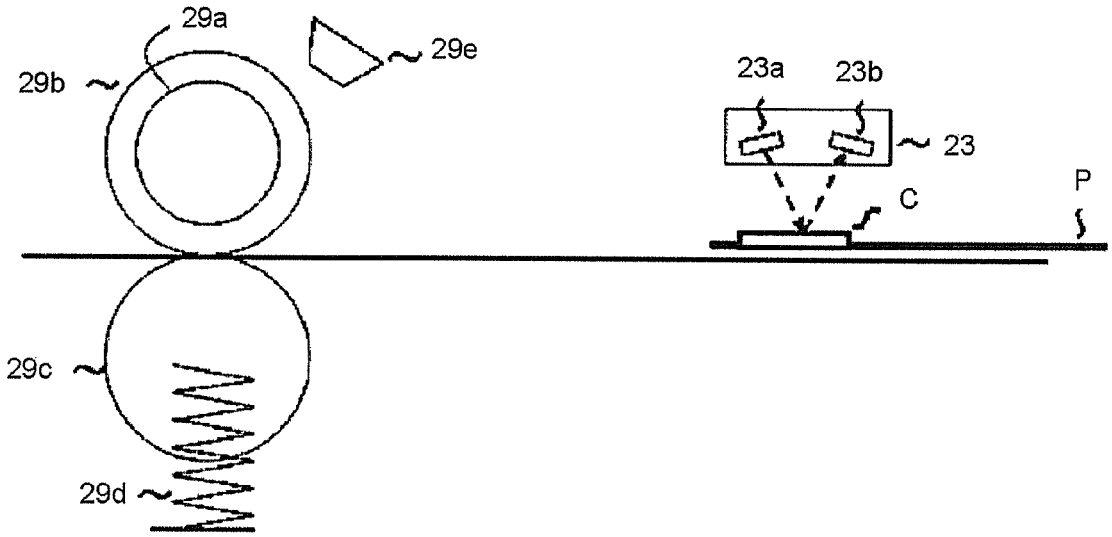

A reading section 23 is arranged in the conveyance section 22 between the sheet feeding section 20 and the intermediate transfer belt 27. Specifically, the reading section 23 is arranged at the upstream side of the register roller 24 in the sheet P conveyance direction, and at the downstream side of a junction of a reversal path through an ADU (automatic duplex unit) 31 described later. The reading section 23 is, for example, a CCD sensor. As shown in FIG. 5, the reading section 23 is an optical sensor including a light emitting section 23*a* and a light receiving section 23*b*. In the present embodiment, the reading section 23 reads the identifier M formed at the end portion of the sheet P.

The image forming process is described in detail below. As shown in FIG. 1, an image forming section 25, an exposure section 26, the intermediate transfer belt 27 and a transfer section 28 function as well-known image forming modules for forming an image. The image forming section 25 forms an image to be transferred onto a sheet. As an example of configuration of generating a color image shown in FIG. 1, though it is described later, the image forming section 25Y performs color separation for an image of the original document to form an image corresponding to yellow part with the yellow toner. The image forming section 25M forms an image with magenta toner in the same way. The image forming section 25C forms an image with cyan toner. The image forming section 25K forms an image with black toner. Each of the image forming sections 25Y, 25M, 25C and 25K overlaps and transfers toner image of each color on the intermediate transfer belt 27. On the other hand, the image forming section 25D is used in a case of reusing the sheet to generate a decolorable image of the original document with the decolorable toner. The color of the decolorable toner as described above is deep blue or black. Thus, the image formed by the image forming section 25D is a monochrome image. As a well-known constitution, for example, each of the image forming sections 25Y, 25M, 25C, 25K and 25D consists of a photoconductive drum, a charging charger, a developing section having a toner, a charge removing section (only shown in FIG. 1) and the like. Though the image forming section 25D is used only in the case of reusing the sheet, the constitution and the operation of the image forming section 25D are the same as that of other image forming sections, thereby being described at the same time in the following description.

Each of the image forming sections 25Y, 25M, 25C, 25K and 25D includes a well-known sensor such as an electric potential sensor or a density sensor (neither is shown). The electric potential sensor detects the surface potential of the photoconductive drum included in each image forming section. The well-known charging charger charges the surface of each photoconductive drum before the photoconductive drum is exposed by an exposure section 26 described later in each of image forming sections 25Y, 25M, 25C, 25K and 25D. The system control section 5 changes a charging condition with the charging charger. The electric potential sensor detects the surface potential of the photoconductive drum the surface of which is charged by the charging charger. The density sensor detects the density of the toner image transferred on the intermediate transfer belt 27 described later, or may detect the density of the toner image formed on the photoconductive drum.

The exposure section 26 forms an electrostatic latent image of the image of the original document acquired by the scanner section 1 on the charged photoconductive drum of each of image forming sections 25Y, 25M, 25C, 25K and 25D through a laser light. The electrostatic latent image formed on each photoconductive drum is developed by a toner of each color. That is, the exposure section 26 irradiates each photoconductive drum through an optical system such as a polygon mirror with the laser light corresponding to each image forming section controlled according to the image data. The exposure section 26 controls the power of the laser light in response to a control signal from the system control section 5, and also controls modulation quantity of a pulse width for controlling the radiation of the laser light in response to a control signal from the system control section 5.

As stated above, each of image forming sections 25Y, 25M, 25C, 25K and 25D develops the electrostatic latent image formed on the photoconductive drum thereof respectively with a toner of each color through the developing section to form a toner image on the photoconductive drum as a visible image. The intermediate transfer belt 27 is an intermediate transfer body. If the color image is formed with the abovementioned non-decolorable toner, each of image forming sections 25Y, 25M, 25C and 25K transfers (primarily transfers) the toner image formed on the photoconductive drum thereof to the intermediate transfer belt 27. Specifically, each of image forming sections 25Y, 25M, 25C and 25K applies a transfer bias to the toner image at the primary transfer position and controls the transfer bias through the transfer current. The toner image on each photoconductive drum is transferred on the intermediate transfer belt 27 through the transfer bias at each primary transfer position (e.g. a connection portion between the photoconductive drum and the transfer belt). The system control section 5 controls the transfer current used in the primary transfer processing by each image forming section. On the other hand, if the sheet is reused, that is, the monochrome image is formed with the decolorable toner, the image forming section 25D forms a toner image on the photoconductive drum as a visible image, and the toner image is transferred on the intermediate transfer belt 27 in the same way as described above.

The transfer section 28 transfers the toner image on the intermediate transfer belt 27 onto the sheet P at the secondary transfer position. The transfer section 28 includes a supporting roller 28*a* and a secondary transfer roller 28*b* arranged along the conveyance path of the sheet P, and the secondary transfer position is a position where the supporting roller 28*a* faces the secondary transfer roller 28*b* across the intermediate transfer belt 27. The transfer section 28 applies a transfer bias controlled through the transfer current to the intermediate transfer belt 27 at the secondary transfer position. The transfer section 28 transfers the toner image on the intermediate transfer belt 27 onto the sheet P through the transfer bias. The system control section 5 controls the transfer current used in the secondary transfer processing.

A fixing device 29 arranged at the downstream side of the transfer section 28 has a function of fixing toner on the sheet P. For example, in the embodiment, the fixing device 29 fixes the toner image on the sheet P by applying heat and pressure to the sheet P.

In each example of the configuration shown in FIG. 1 and FIG. 5, the fixing device 29 is constituted by a heat roller (heating section) 29*b* in which a heating source 29*a* is embedded, and a pressure roller (pressure section) 29*c* connected with the heat roller 29*b* in a pressure state through a pressure mechanism 29*d*. The heating source 29*a* may be a heater the temperature of which can be controlled. For example, the heating source 29*a* may be constituted by a heater lamp such as a halogen lamp and the like, may be an IH (induction heating) system heater, or may include a plurality of heaters. As shown in FIG. 5, the fixing device 29 further includes a temperature sensor 29*e* for measuring the temperature of the heat roller 29*b*. The temperature sensor 29*e* sends the temperature of the heat roller 29*b* to the system control section 5 described later. The pressure mechanism 29*d* made from elastic member presses the pressure roller 29*c* towards the heat roller 29*b*. If the pressure roller 29*c* is not pressed towards the heat roller 29*b* by the pressure mechanism 29*d*, the pressure roller 29*c* is separated from the heat roller 29*b*, thereby forming a gap therebetween.

If a fixing processing through which the toner image is fixed on the sheet P is carried out, the system control section 5 controls the temperature of the fixing device 29 to be a prescribed fixing temperature. The fixing device 29 pressurizes the sheet P on which the toner image is transferred by the transfer section 28 while heating the sheet P at the fixing temperature. In this way, the fixing device 29 fixes a toner image on the sheet P. The sheet P subjected to the fixing processing is conveyed to either of the sheet discharging section 30 and the ADU 31 through a well-known bifurcating mechanism (not shown) arranged at the downstream side of the fixing device 29 according to the processing requirement of a user.

If an erasure processing is carried out on the image formed on the sheet P, the system control section 5 controls the temperature of the fixing device 29 to be a prescribed decoloring temperature. The fixing device 29 pressurizes the sheet P to be subjected to the erasure processing while heating the sheet P at the decoloring temperature. Thus, the fixing device 29 erases the image formed on the sheet P. If the image is erased by the fixing device 29, the sheet P is conveyed to the sheet discharging section 30.

In a case in which the sheet P subjected to the fixing processing or the erasure processing by the fixing device 29 is discharged, the sheet P is carried out to the sheet discharging section 30. In a case in which an image is also formed on the back side of the sheet P subjected to the fixing processing by the fixing device 29, the sheet P is switched back to be conveyed to the ADU 31 after the sheet P is conveyed to the side of the sheet discharging section 30 temporarily. In this case, the ADU 31 supplies the sheet P reversed by the switchback operation to the upstream side of the register roller 24 and the reading section 23 once again.

In the present embodiment, if a sheet P including the identifier M formed in the check box C shown in FIG. 3 is conveyed, the press operation of the pressure roller 29*c* is released and the pressure roller 29*c* is separated from the heat roller 29*b* to convey the sheet P to the sheet discharging section 30. That is, the erasure processing is not carried out on the sheet P including the identifier M.

The operation panel 4 is a user interface. The operation panel 4 includes various well-known input buttons and a display section 4*a* equipped with a touch panel 4*b*. The system control section 5 controls the content displayed on the display section 4*a* of the operation panel 4. The operation panel 4 outputs information input through the input buttons or the touch panel 4*b* of the display section 4*a* to the system control section 5. The input of information required for the printing operation such as number of printing sheets and density is received. The operator operates the operation panel 4 to select either the printing mode or the erasure mode. The printing mode is a mode for forming the image on the sheet set in the sheet feeding section. The erasure mode is a mode for erasing the image formed on the sheet set in the sheet feeding section. That is, in the erasure mode, the sheet feeding section 20, the conveyance section 22 and the fixing device 29 are used to erase the image formed on the sheet without using the image forming section 25, the exposure section 26, the intermediate transfer belt 27 and the transfer section 28 of the printer section 2.

Figure 2:
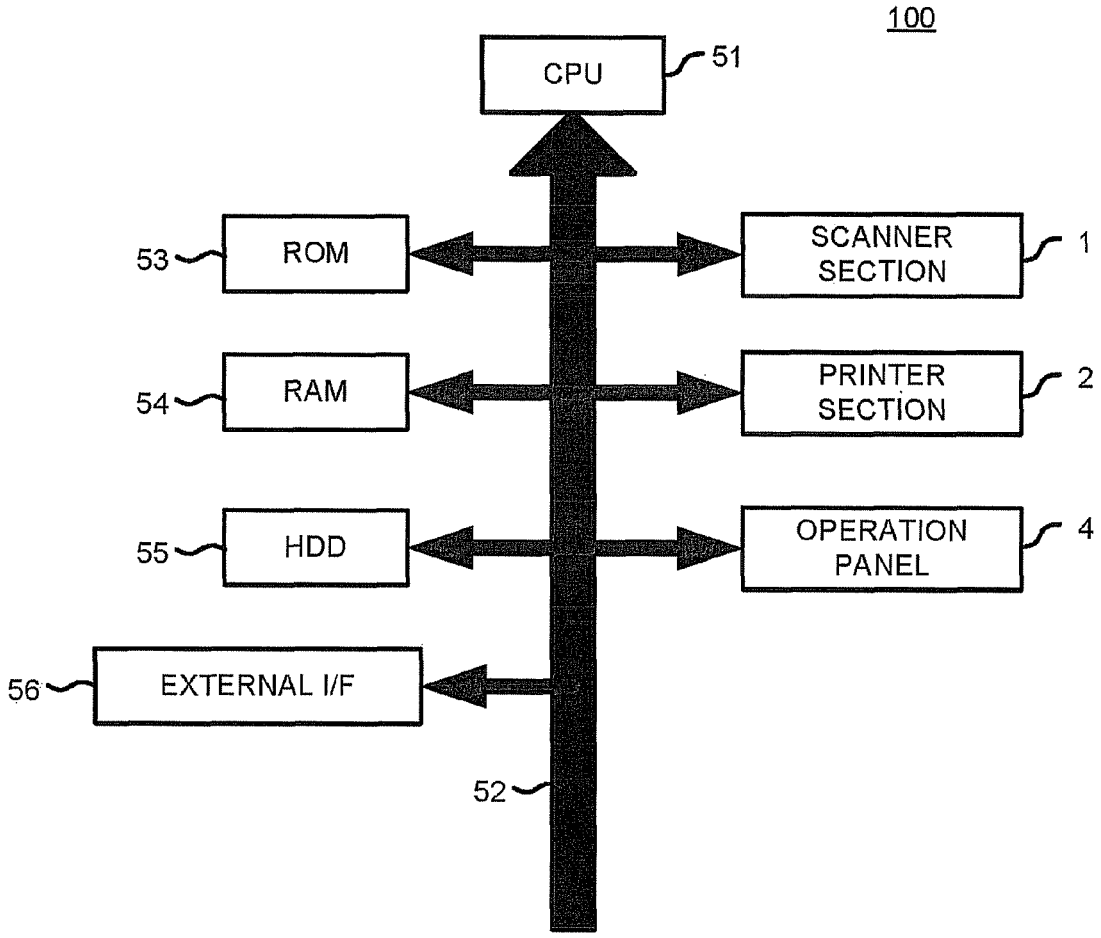
FIG. 2 is a block diagram of the image forming apparatus according to the embodiment.

Next, the constitution of the control system of the MFP 100 is described. FIG. 2 is a block diagram of the MFP 100 according to the present embodiment. A CPU (Central Processing Unit) 51, a ROM (Read Only Memory) 53, a RAM (Random Access Memory) 54, an HDD (Hard Disk Drive) 55, an external I/F (Interface) 56, the printer section 2 and the operation panel 4 are connected with each other via a system bus 52. The CPU 51, the ROM 53 and the RAM 54 constitute the system control section 5.

The ROM 53 previously stores threshold value or a program for activating the CPU 51. For example, the fixing temperature capable of fixing the decolorable toner or the non-decolorable toner is also stored. A temperature threshold value serving as a set temperature (decoloring temperature) of the heat roller in a case of erasing the image formed on the sheet P is also stored in the temperature threshold value storage area of the ROM 53. When the check box C is read by the reading section 23, a density threshold value serving as a threshold value used to determine whether or not the check box C is daubed is stored in the density threshold value storage area.

Various kinds of memory areas such as a work area serving as a working area for the data processing according to a program are dynamically formed in the RAM 54. A flag area for managing whether or not the identifier M, daubed check box C, is detected is arranged in the RAM 54. Specifically, an identifier M management area is arranged, and the default value of the flag stored in the identifier M management area is '0'. If the identifier M is detected, then the RAM 54 updates the flag to be '1'. Every time the erasure processing of a sheet is completed, the flag is reset to be '0 '. A mode identification area is arranged in the RAM 54. The mode identification area is a flag area for determining the current mode. In a case of the printing mode, the flag is stored to be '1', and in a case of the erasure mode, the flag is stored to be '0'. It is assumed that '1' is stored by default.

The OS (Operating System) for activating the MET 100 is installed in the HDD 55. The HDD 55 has a temporary storage area for temporarily storing the image information read from the sheet P by the scanner section 1. A warning message displayed on the operation panel 4 is also stored in the HDD 55.

The external I/F 56 is an interface for communicating with external devices. For example, the external I/F 56 receives print data with respect to the printing requirement from an external device, e.g., a client terminal (PC). No limitation is given to the external I/F 56 as the external I/F 56 is an interface used to carry out data communicate with external devices. For example, the external I/F 56 may be a machine (e.g. a USB or memory) locally connected with external devices, or maybe a network interface for executing communication through network.

The constitutions of the scanner section 1, the printer section 2 and the operation panel 4 are described above, thus detailed description thereof is omitted.

Figure 4:
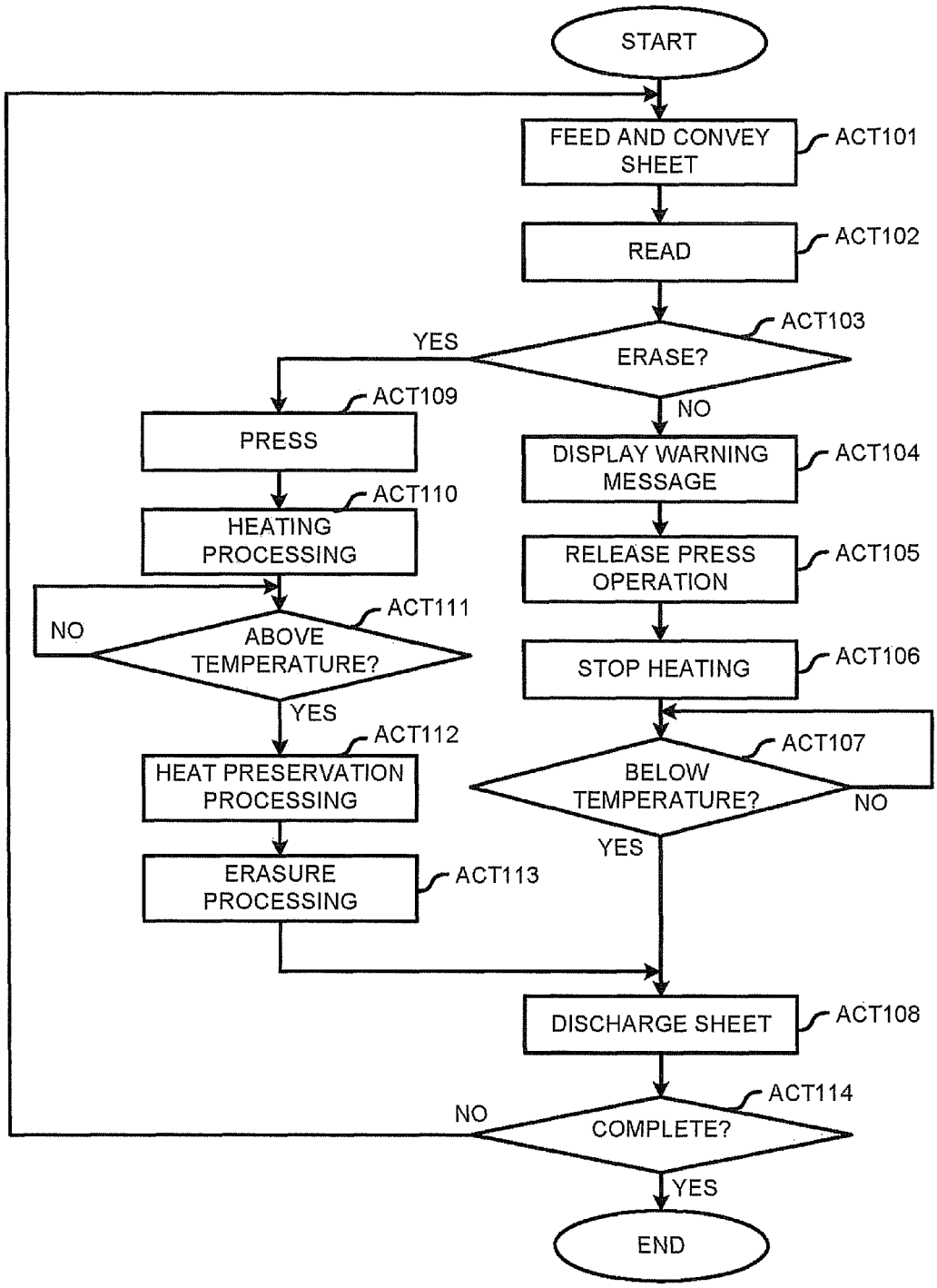
FIG. 4 is a flowchart illustrating a process of an erasure job of the image forming apparatus according to the embodiment.

If an erasure mode of the sheet P is selected from the operation panel 4 in the MFP 100 with such a constitution described above, the MFP 100 executes an erasure job (erasure processing) shown in FIG. 4 according to a preset program.

When the MFP 100 executes an erasure job, it is assumed that the sheet P to be subjected to erasure processing has already set in, for example, the sheet feeding cassette 20B of the sheet feeding section. It is assumed that the identifier M is formed previously on a part of the sheets P (the sheet on which the image is not desired to be erased) set in the sheet feeding cassette 20B.

The system control section 5 picks up the sheet P through the pickup roller 21B from the sheet feeding cassette 20B of the sheet feeding section. Then, the system control section 5 controls the conveyance section 22 to convey the sheet P to the register roller 24 (Act 101).

Figure 6:
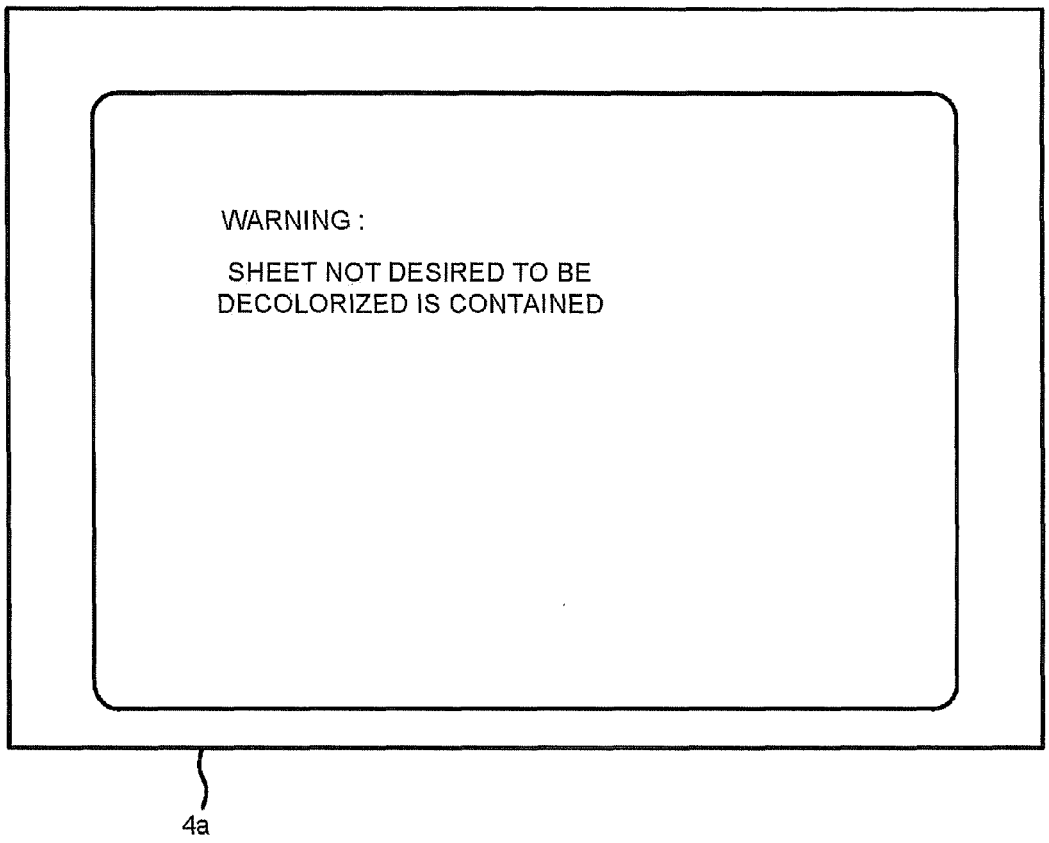
FIG. 6 is a display example representing a warning message according to the embodiment.

The system control section 5 controls the reading section 23 to read the check box C printed on the sheet P during conveyance to the register roller 24 (Act 102). The system control section 5 compares information sent from the reading section 23 with the value stored in the density threshold value storage area of the ROM 53 (Act 103). As shown in FIG. 5(*a*), if the system control section 5 determines that the identifier M is formed, that is, the check box C is daubed (No in Act 103), the flag stored in the identifier M management area is changed from '0' to '1'. The system control section 5 reads the warning message from the HDD 55 to display the warning message on the operation panel 4 as shown in FIG. 6. In addition, the system control section 5 controls the register roller 24 to stop the conveyance of the sheet P (Act 104).

After displaying the warning message, the system control section 5 refers to the flag of the identifier M management area to release the press operation of the pressure mechanism 29*d*, and the press operation executed on the pressure roller 29*c* towards the heat roller 29*b* is released. Thus, the pressure roller 29*c* and the heat roller 29*b* are separated from each other, thereby forming a gap therebetween (Act 105).

Subsequently, the system control section 5 stops the heat generation of the heating source 29*a* (Act 106). By comparing the value sent from the temperature sensor 29*e* for detecting the temperature of the heat roller 29*b* with the value stored in the temperature threshold value storage area of the ROM 53, the system control section 5 determines whether the temperature of the heat roller 29*b* reaches the temperature at which it is impossible to erase the image formed on the sheet P (Act 107). If the system control section 5 determines that the temperature of the heat roller 29*b* does not reach the non-erasable temperature for the image on the sheet P (No in Act 107), the Act 107 is taken again. On the other hand, if the system control section 5 determines that the temperature of the heat roller 29*b* reaches the non-erasable temperature for the image on the sheet P (Yes in Act 107), the sheet P passes through the gap between the pressure roller 29*c* and the heat roller 29*b* to be conveyed to the sheet discharging section 30 by driving the register roller 24. Then, the flag of the, identifier M management area is changed from '1' to '0' (Act 108).

Next, the system control section 5 refers to the value of the sheet feeding section sensor to determine whether there is a sheet P in the sheet feeding cassette 20B (Act 114). If that there is a sheet P in the sheet feeding cassette 20B is determined (No in Act 114), Act 101 is taken again to feed the sheet P from the sheet feeding cassette 20B. On the other hand, if that there is no sheet P in the sheet feeding cassette 20B is determined (Yes in Act 114), the erasure processing is ended.

In Act 103, as shown in FIG. 5(*b*), if it is determined that no identifier M is formed on the sheet P, that is, the check box C is not daubed (Yes in Act 103), the system control section 5 refers to the flag of the identifier M management area to carry out press operation of the pressure mechanism 29*d* (Act 109). Thus, a nip is formed between the pressure roller 29*c* and the heat roller 29*b*.

The system control section 5 heats the heating source 29*a*to increase the temperature of the heat roller 29*b* (Act 110). By comparing the value sent from the temperature sensor 29*e* with the value stored in the temperature threshold value storage area of the ROM 53, the system control section 5 determines whether the temperature of the heat roller 29*b* reaches the temperature at which the image formed on the sheet P can be erased (Act 111). If it is determined that the temperature of heat roller 29*b* does not reach the erasable temperature for the image formed on the sheet P (No in Act 111), the system control section 5 carries out the determination of Act 111 again. On the other hand, if it is determined that the temperature of heat roller 29*b* reaches the decolorable temperature for the image formed on the sheet P (Yes in Act 111), the system control section 5 stops the heat operation of the heating source 29*a* to maintain the temperature of the heat roller 29*b* to be the decoloring temperature (Act 112).

The system control section 5 drives the register roller 24 to make the sheet P pass through the nip between the pressure roller 29*c* and the heat roller 29*b*, thereby erasing the image formed on the sheet P (Act 113). After passing through the fixing device 29, the sheet P is conveyed to the sheet discharging section 30 (Act 108).

Similar to the above description, the system control section 5 refers to the value of the sheet feeding section sensor to determine whether there is a sheet P in the sheet feeding cassette 20B (Act 114). If that there is a sheet P in the sheet feeding cassette 20B is determined (No in Act 114), Act 101 is taken again to feed the sheet P from the sheet feeding cassette 20B. On the other hand, if that there is no sheet P in the sheet feeding cassette 20B (Yes in Act 114), the erasure processing is ended.

As stated above, for example, in a case where an operator decolorizes a sheet on which the content is recorded with a writing material the ink of which is colorless according to the change of the temperature with the use of an MFP arranged in the convenience store, even if the paper which is not desired to be decolorized is mixed by mistake, it is possible to escape from the erasure processing by previously forming an identifier indicating whether to carry out the decoloring processing in the check box of the paper. In the present embodiment, if it is determined that the sheet P is not desired to be erased, for example, the press operation between the heat roller 29*b* and the pressure roller 29*c* is released. Thus, even if the temperature of the heat roller 29*b* is lower than the decoloring temperature, it is possible to prevent the image formed on the sheet P from being erased through the press force applied to the sheet P.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a fixing device configured to include a pressure section and a heating section for heating an image receiving medium and to execute a fixing processing for fixing an image formed on the image receiving medium with a decolorable color material at a fixing temperature or an erasure processing for erasing an image at a decoloring temperature, the pressure section of the fixing device is arranged separably from a heating section of the fixing device;

a reading section configured to be arranged at the upstream side of the fixing device in the conveyance direction of the image receiving medium to read an identifier indicating whether or not the color material of the image formed on the image receiving medium can be decolorized;

a control section configured to control the execution of the erasure processing of the image on the image receiving medium with the fixing device according to a result of reading of the identifier with the reading section; and if the erasure processing is not executed according to the result of reading of the identifier on the image receiving medium with the reading section, the control section controls to separate the pressure section from the heating section to release press operation and then to convey the image receiving medium to a space between the pressure section and the heating section.

2. The image forming apparatus according to claim 1, wherein if the erasure processing is executed according to the result of reading of the identifier on the image receiving medium with the reading section, the control section controls to press the pressure section towards the heating section and to increase the temperature of the heating section up to a prescribed decoloring temperature so as to erase the image on the image receiving medium conveyed to a space between the heating section and the pressure section.

3. The image forming apparatus according to claim 2, further comprising:

a display section, wherein the control section controls to stop conveyance of the image receiving medium and to display a warning message on the display section if the erasure processing is not executed according to the result of reading of the identifier on an image receiving medium with the reading section.

4. The image forming apparatus according to claim 1, wherein the control section controls to stop the heat generation of the heating section if the erasure processing is not executed according to the result of reading of the identifier on the image receiving medium with the reading section.

* * * * *